US005681246A

United States Patent [19]

Dougherty

[11] Patent Number: 5,681,246

[45] Date of Patent: Oct. 28, 1997

[54] PIVOTING JUMP STICK

[76] Inventor: Zachary Dougherty, P.O. Box 95, Hobart, Wash. 98025

[21] Appl. No.: 752,845

[22] Filed: Nov. 21, 1996

[51] Int. Cl.[6] ..... A63B 5/22

[52] U.S. Cl. ..... 482/81; 482/148

[58] Field of Search ..... 422/81, 82, 148

[56] References Cited

U.S. PATENT DOCUMENTS

| | | | |
|---|---|---|---|
| 1,826,944 | 10/1931 | McGavin | 482/81 |
| 2,181,979 | 12/1939 | Schaeffer | 482/81 |
| 3,110,493 | 11/1963 | Thompson | 482/81 |
| 3,182,999 | 5/1965 | Updaw | 482/81 |
| 3,531,111 | 9/1970 | Shafer | 482/81 |
| 3,589,719 | 6/1971 | Glass et al. | 482/81 |
| 5,215,509 | 6/1993 | Meyer | 482/81 |
| 5,470,296 | 11/1995 | Welte | 482/81 |

*Primary Examiner*—L. Reichard
*Attorney, Agent, or Firm*—Craine & Jackson, P.S.

[57] ABSTRACT

An amusement and exercise device which includes an elongated pole pivotally attached at one end to a base which is removably attached to the ground or floor. Attached to the distal end of the pole is a rope which is manipulated by the user which causes the pole to rotate in a circular path around the base and under the user. The user must coordinate his or her arm and wrist movement and jump over the pole to operate the device.

9 Claims, 1 Drawing Sheet

PIVOTING JUMP STICK

BACKGROUND OF THE INVENTION

1. Field of the Invention:

This invention relates to amusement and exercise devices and, more particularly, to such devices operated by a single user which requires the user to raise his or her arms and jump over a rotating object.

2. Description of the Related Art:

Jump roping is a popular amusement and exercise activity for children and adults which requires the user jump over a rotating rope controlled by the user or by others. Typically, for single users, the ends of the rope are held waist high so that the control portion of the rope rotates under and over the user. During the exercise, the user's legs, lower arms and wrists are exercised, while the upper arms and chest are generally at rest.

One important drawback with jump roping is that a sufficient amount of space above the user is required during use. Due to this requirement, jumping rope inside a building with a standard 8' ceiling is impossible. Another important drawback is that the jumping surface must be smooth so that movement of the rope across the jumping surface is not impeded.

SUMMARY OF THE INVENTION

It is an object of the invention to provide an amusement and exercise device which requires an individual user to exercise the upper arm muscles, chest muscles, and leg muscles.

It is another object of the invention to provide such a device that is easy to use indoors and outdoors by one or two individuals.

It is a further object of the invention to provide such a device which is safe to use and relatively inexpensive to manufacture.

These and other objects are met by providing a pivoting jumping stick comprising an elongated pole pivotally attached at its proximal end to a base which may be temporarily and securely attached to the jumping surface. A double axis pivoting means is provided between the pole and base which enables the pole rotate horizontally 360° and vertically 180° around the base. Attached to the distal end of the pole is a rope with an optional handle attached thereto. The rope is of sufficient length so that when the pole is rotated around the base and positioned under the user, the pole is substantially horizontally aligned above the jumping surface near the user's feet so that the user may jump thereover. In one embodiment, the handle is hollow and includes a removable cap which enables stakes used to attach the base to the jumping surface to be stored therein.

DESCRIPTION OF THE PREFERRED EMBODIMENT(S)

Figure 1:
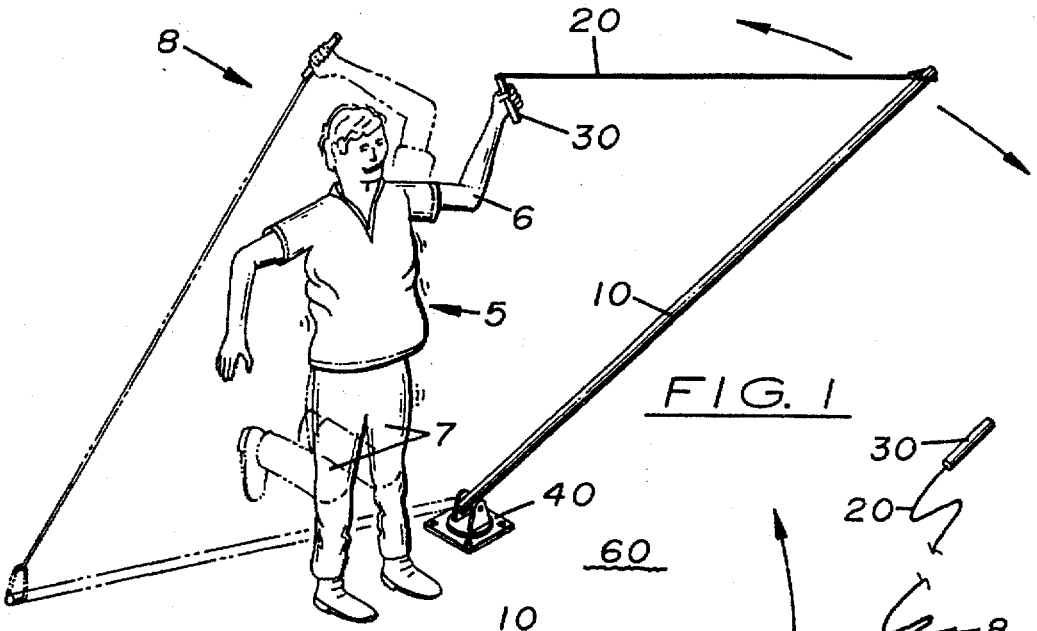
FIG. 1 is a perspective view of the invention disclosed therein.
Figure 2:
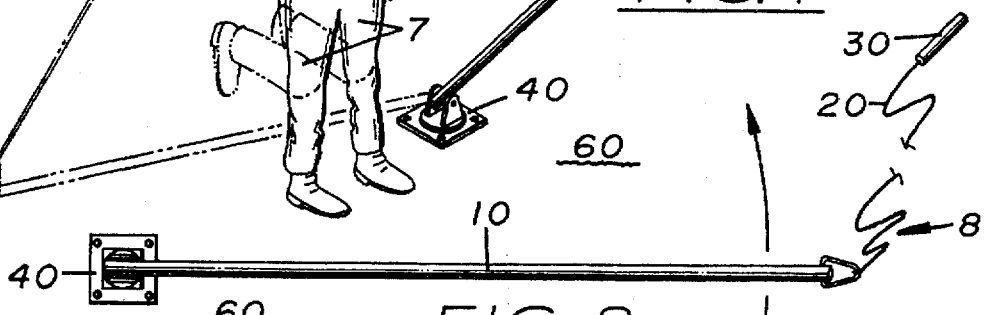
FIG. 2 is a top plan view of the invention.
Figure 7:
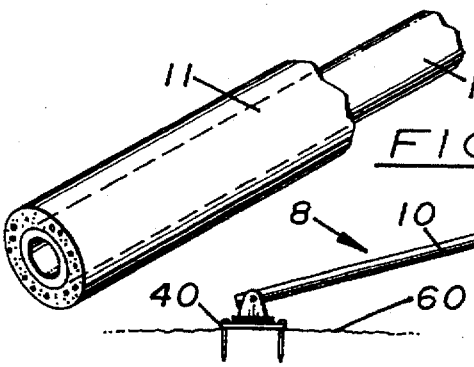
FIG. 7 is a perspective view of the handle.
Figure 3:
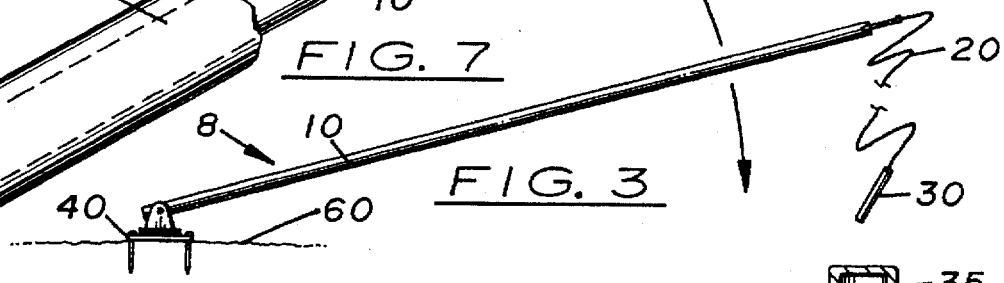
FIG. 3 is a is a side elevational view of the invention.
Figure 4:
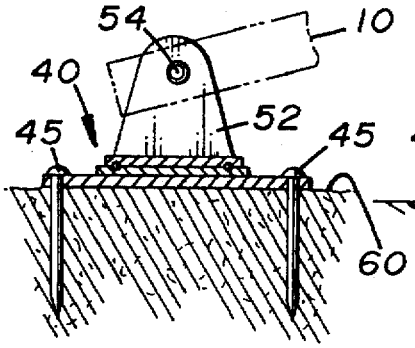
FIG. 4 is a sectional, side elevational view of the base attached to the ground.

Shown in the accompanying FIGS. 1–7, there is shown a pivoting jumping stick, generally indicated by reference number 8, which comprises an elongated pole 10 attached at its proximal end 14 to a base 40. The base 40 is temporarily attached to a jumping surface 60. Disposed between the proximal end 14 of pole 10 is a double axis pivoting means, generally referred to as 50, which enables the pole 10 to rotate horizontally 360° and vertically 180° around the base 40 during use. Attached to the distal end 12 of the pole 10 is a flexible rope 20 with an optional handle 30 attached to its distal end 22.

In a first embodiment shown in FIGS. 1–6, the pole 10 is hollow and made if lightweight material, such as aluminum or PVC, 4 to 6 feet in length and ¾ to 1 inch in diameter. In a second embodiment, shown in FIG. 7, the pole 10 is covered by an outer tube 11 made of foam material to provide additional protection against impacts.

The proximal end 24 of the rope 20 is attached directly to the distal end 12 of the pole 10. In the embodiment shown, rope 20 is between 5 to 7 feet in length.

Attached to the distal end 22 of the rope 20 is an optional handle 30. In the preferred embodiment, the handle 30 is rotatably attached to the distal end 22 so that the rope 20 freely rotates in the user's hand during use. In the embodiment shown, the handle 30 includes a short, tubular body 32 with a fixed lower end cap 34 and a removable upper cap 35. The tubular body 32 is approximately 1 inch in diameter and 6 inches in length. The tubular body 32 is hollow so that the removable stakes 45 used to attach the base 40 to a soft jumping surface 60, as described, may be stored inside.

Figure 5:
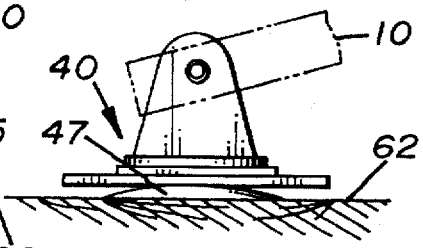
FIG. 5 is a sectional, side elevational view of the base attached to a hard floor.
Figure 6:
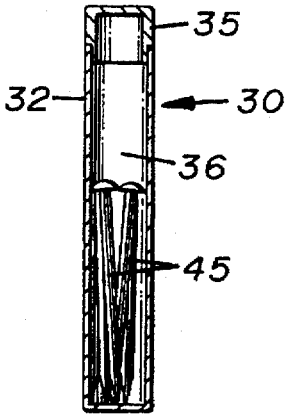
FIG. 6 is a sectional, side elevational view of the handle.

In another embodiment, shown in FIG. 5, the stakes 45 are replaced with a suction cup 47 which enables the base 40 to be temporarily attached to a hard, smooth jumping surface 62.

The base 40 includes a flat plate 42 with a plurality of perpendicularly aligned stakes 45 or suction cups 47 attached to the bottom surface. During use, the stakes 45 or suction cups 47 are used to temporarily yet securely attach the base 40 to a soft jumping surface 60. In one embodiment, the stakes 40 are removably attached to the plate 42 so that they may be detached thereon and stored in the handle 30.

Attached to the upper surface of the plate 42 is a double axis pivoting means which attaches the proximal end 14 of the pole 10 to the base 40. In the embodiment shown, the double axis pivoting means 50 is an upward extending, rotating bracket 52 with a horizontally aligned axle 54 attached between two bores 56 formed in the two arms on bracket 52. A transversely aligned hole 13 is formed near the distal end of the pole 10 through which the axle 54 is extended to pivotally attach the pole 10 to the bracket 52. The bracket 52 is rotatably connected to the top surface of plate 42 similar to a castor wheel.

During manufacturing, the pole 10, rope 20, handle 30 and base 40 are properly assembled in the manner described above. To use the device 8, a suitable jumping surface 60 or 62 is selected to which the base 40 can be attached. The base 40 is then attached to the jumping surface 60 or 62 using stakes or suction cup 47. The user positions himself or herself adjacent to the base 40 while holding the handle 30 in the hand on the opposite side of the body to the base 40. The user then begins to rotate the pole 10 in a circular path around the base 40 by twisting his or her wrists and raising his or her hand between an a position immediately above his or her head and his or her shoulder. By moving his arms and hands in this manner, the pole 10 is able to rotate freely around the base 40. As the pole 10 is rotated to a position immediately adjacent to the user, the handle 30 is held above the user's head so that the pole 10 is positioned adjacent to his or her feet and slightly above the ground so that the user may jump thereover. Movement of the user's wrist, arms and legs are then coordinated so that the pole 10 moves in an elliptical path around the base 40.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. A pivoting jumping stick, comprising:

a) a base capable of being removably attached to a jumping surface;

b) an attachment for selectively attaching said base to a jumping surface;

c) a pole having a proximal end and an opposite distal end;

d) a double axis pivoting means disposed between said base and said proximal end of said pole, said double axis pivoting means enables said pole to pivot horizontally 360° and vertically 180° around said base, and;

e) a rope attached to said distal end of said pole, said rope being sufficient of length to enable a user to rotate said pole 360° around said base and jump thereover while holding the opposite end thereof.

2. A pivoting jumping stick, as recited in claim 1, wherein said attachment means has at least one stake capable of being inserted into said jumping surface to securely attach said base thereto.

3. A pivoting jumping stick, as recited in claim 2, further including a handle pivotally attached at one end of said rope.

4. A jumping stick, as recited in claim 3, wherein said handle includes a storage space formed therein to allow said stakes to be stored therein.

5. A jumping stick, as recited in claim 4, wherein said pole has an outer foam layer attached thereto.

6. A jumping stick, as recited in claim 1, wherein said attachment means is a suction cup.

7. A pivoting jumping stick, as recited in claim 6, further including a handle pivotally attached at one end of said rope.

8. A jumping stick, as recited in claim 2, wherein said double axis is an upward extending bracket rotatably attached to said base, a horizontally disposed axle attached to said bracket, a base formed near said proximal end of pole enables said pole to be rotatably attached to said bracket.

9. A jumping stick, as recited in claim 6, wherein said double axis is an upward extending bracket rotatably attached to said base, a horizontally disposed axle attached to said bracket, a base formed near said proximal end of pole enables said pole to be rotatably attached to said bracket.

* * * * *